United States Patent [19]

Beinhaur et al.

[11] Patent Number: 4,834,673

[45] Date of Patent: May 30, 1989

[54] FLAT CABLE POWER DISTRIBUTION SYSTEM

[75] Inventors: Ernest L. Beinhaur, Harrisburg, Pa.; John K. Daly, Scottsdale; Earl R. Kreinberg, Phoenix, both of Ariz.; Paul Vinson, Carefree, Ariz.

[73] Assignee: AMP Incorporated, Harrisburg, Pa.

[21] Appl. No.: 236,313

[22] Filed: Aug. 23, 1988

Related U.S. Application Data

[63] Continuation of Ser. No. 050,793, May 14, 1987, abandoned.

[51] Int. Cl.[4] ..... H01R 4/24

[52] U.S. Cl. ..... 439/422

[58] Field of Search ..... 439/409, 410, 421, 422

[56] References Cited

U.S. PATENT DOCUMENTS

| | | | |
|---|---|---|---|
| 2,020,408 | 11/1935 | Fruth . | |
| 3,138,658 | 6/1964 | Weimer, Jr. . | |
| 3,197,729 | 7/1965 | Sarazen . | |
| 3,223,775 | 12/1965 | Nugent . | |
| 3,247,316 | 4/1966 | Weimer, Jr. . | |
| 3,363,224 | 1/1968 | Gluntz . | |
| 3,466,382 | 9/1969 | Rocklitz . | |
| 3,541,226 | 11/1970 | Cea et al. . | |
| 3,541,227 | 11/1970 | Bendrick . | |
| 3,708,609 | 1/1973 | Iosue et al. . | |
| 3,708,610 | 1/1973 | Kozel et al. . | |
| 3,752,901 | 8/1973 | Kuo . | |
| 3,893,233 | 7/1975 | Glover . | |
| 3,924,917 | 12/1975 | Munshower . | |
| 3,949,277 | 4/1976 | Yosset . | |
| 3,960,430 | 6/1976 | Bunnell et al. . | |
| 4,062,610 | 12/1977 | Doty et al. . | |
| 4,066,319 | 1/1978 | Baker et al. . | |
| 4,106,836 | 8/1978 | Asick et al. | 439/422 |
| 4,133,101 | 1/1979 | Glover . | |
| 4,186,982 | 2/1980 | Cobaugh et al. . | |
| 4,194,801 | 3/1980 | Fitzler et al. . | |
| 4,236,038 | 11/1980 | Taylor . | |
| 4,236,046 | 11/1980 | DeVries . | |
| 4,248,493 | 2/1981 | Kuo | 439/422 |
| 4,263,474 | 4/1981 | Tennant . | |
| 4,357,065 | 11/1982 | Kam et al. . | |
| 4,371,225 | 2/1983 | Narozny . | |
| 4,381,423 | 4/1983 | Taylor . | |
| 4,382,156 | 5/1983 | Jodoin . | |
| 4,385,794 | 5/1983 | Lucius . | |
| 4,394,532 | 7/1983 | Aguayo . | |
| 4,399,321 | 8/1983 | Gottlieb . | |
| 4,401,843 | 8/1983 | Harper et al. . | |
| 4,405,189 | 9/1983 | Douty et al. . | |
| 4,420,653 | 12/1983 | Fukuda et al. . | |
| 4,435,035 | 3/1984 | Berry et al. . | |
| 4,436,953 | 3/1984 | Gottlieb . | |
| 4,440,972 | 4/1984 | Taylor . | |
| 4,451,694 | 5/1984 | Harper et al. . | |
| 4,463,998 | 8/1984 | Reavis et al. . | |
| 4,490,904 | 1/1985 | Moyher . | |
| 4,544,220 | 10/1985 | Aiello et al. . | |
| 4,551,579 | 11/1985 | Takasaki . | |
| 4,560,224 | 12/1985 | Weisenberger . | |
| 4,599,486 | 7/1986 | Herrandez . | |
| 4,603,927 | 8/1986 | Gardner . | |

FOREIGN PATENT DOCUMENTS

| | | |
|---|---|---|
| 4120670 | 7/1981 | Japan . |

OTHER PUBLICATIONS

Addendum Figures 1–3, "Bus Bars for PCB Applications Keyed to Design, Performance", Jun. 1984, Electri-Onics, pp. 23–26.

"Printed Circuit Board Bus Bars", Jan. 1979, Western Electrical Engineer, pp. 19–23.

"AMP Engineering & Purchasing Guide", Edition 4, pp. 2.29–2.36.

"Why Flat Cable", W. L. Gore & Assoc. Inc., 11-1-3-79.

"Flat Power Bus", W. L. Gore & Assoc. Inc., 2-19-87.

*Primary Examiner*—Joseph H. McGlynn

*Attorney, Agent, or Firm*—Eric J. Groen; Anton P. Ness

[57] ABSTRACT

A power distribution system utilizes flat power cable in combination with a plurality of adapter members for the distribution of power within electronics systems. The adapter members allow flat power cable to be interconnected to conventional crimpable contacts and thereafter routed through conventional electrical connectors. The adapters also allow interconnection between flat cable and power busses or between flat cables and printed circuit boards. The adapters can also allow the interconnection of tabs and receptacles to flat power cable. The adapters are crimpable to the flat cable by means of hand tools which provides for a versatile means of distributing power.

33 Claims, 11 Drawing Sheets

FLAT CABLE POWER DISTRIBUTION SYSTEM

This application is a Continuation of application Ser. No. 07/050,793 filed May 14, 1987, now abandoned.

BACKGROUND OF THE INVENTION

1. Field of the Invention

The instant invention relates to a means for distributing power within an electronics system. The system includes flat power cable having connected thereto an adapter member which is electrically and mechanically connected to the flat cable. The adapter member can be used to interconnect terminals of conventional connectors thereto, for using flat cable for power distribution through the connectors. Other embodiments of the adapter can be used for printed circuit board mountable connections, and still other embodiments can be used for connection of tab and receptacle type connection systems.

2. Description of the Prior Art

There is a need within the electronics industry for a more versatile and complete means for power distribution within electronic devices such as computers, copying machines, and the like. One method for the distribution of power within electronic equipment is to include a plurality of conductive traces on the printed circuit boards and supply the power through connector systems such as edge card connectors and the like. The power would then be distributed to the daughter boards again through connection systems. This type of power distribution has the inherent drawback of requiring a substantial amount of printed circuit board real estate, a detriment to the electronics industry in light of the requirements for higher and higher density systems. A second method which can be utilized for power distribution within an electronics system is accomplished by hard wiring discrete wires from a source of power to the local power requirement such as printed circuit boards. A third method has been to manufacture bus bars with predetermined mounting features, such has surface mounted tabs or through hole mounting stakes.

For example, U.S. Pat. No. 4,603,927 relates to the third method of power distribution mentioned above. The bussing device disclosed therein relates to single or double thickness conductors having mounting tabs integral with the conductors and extending therefrom. The bus then includes insulation which is wrapped around the conductors leaving the tabs extending therethrough. By manufacturing the bus bars in this manner, that is by having the mounting tabs integral with the conductors, the spacing between the mounting tabs must be predetermined. Thus for each different application, a new cable must be made which detracts from the versatility of the bus bar system. Furthermore, by manufacturing the cable in this manner the insulation must be laminated around the conductor leaving the tabs exposed increasing the cost of manufacturing the cable.

Other U.S. Patents relating to bussing systems in general include U.S. Pat. Nos. 3,708,610; 3,218,606; 3,396,230; 3,491,267; 3,668,606 and 3,808,588.

Means in general for interconnection to flat conductors are shown in references such as U.S. Patent Nos. 4,551,579; 4,263,474; 3,960,430; 3,752,901; 3,541,227; 3,197,729; and 3,138,658. U.S. Pats. Nos. 4,551,579; 4,263,474 and 3,960,430 relate to electrical interconnections for undercarpet power cable, whereas the balance of the references relate to interconnecting flat cable to round wire.

SUMMARY OF THE INVENTION

It is an object of the instant invention to devise a versatile power distribution system utilizing flat power conductors.

It is an object of the instant invention to devise a power distribution system having versatile application to any power distribution requirement.

It is a further object of the instant invention to devise an adapter which is crimpable to a flat power conductor which may be used for interconnecting conventional wire crimp terminals thereto.

It is a further object of the instant invention to devise an adapter which is electrically connectable to a flat power conductor which can be used for distributing power to printed circuit boards.

It is a further object of the invention to design the adapters for interconnection to the flat cable such that the adapters can be installed at any location of the flat cable precluding the requirement for predesigned closely toleranced power cables.

It is a further object of the invention to remove the labor intensity of present power distribution systems.

Other objects will become apparent upon a reading of the detailed description.

The above objects are accomplished by using flat cable for power distribution allowing a single interconnection to the flat cable providing a plurality of power taps off of the flat cable. The adapter member is interconnectable to the flat cable via an insulation displacement portion which allows the connections to be placed at any desired location, removing the requirement of closely toleranced, pre-manufactured bussing systems. The several components which are available for use with the cable allows the system to be very versatile and allows the designer to use his or her imagination when it comes to designing the power distribution system.

BRIEF DESCRIPTION OF THE DRAWINGS

FIG. 3 is a perspective view similar to that of FIG. 2 showing how the adapter is inserted onto the flat cable.

DETAILED DESCRIPTION OF THE PREFERRED EMBODIMENTS

Figure 1:
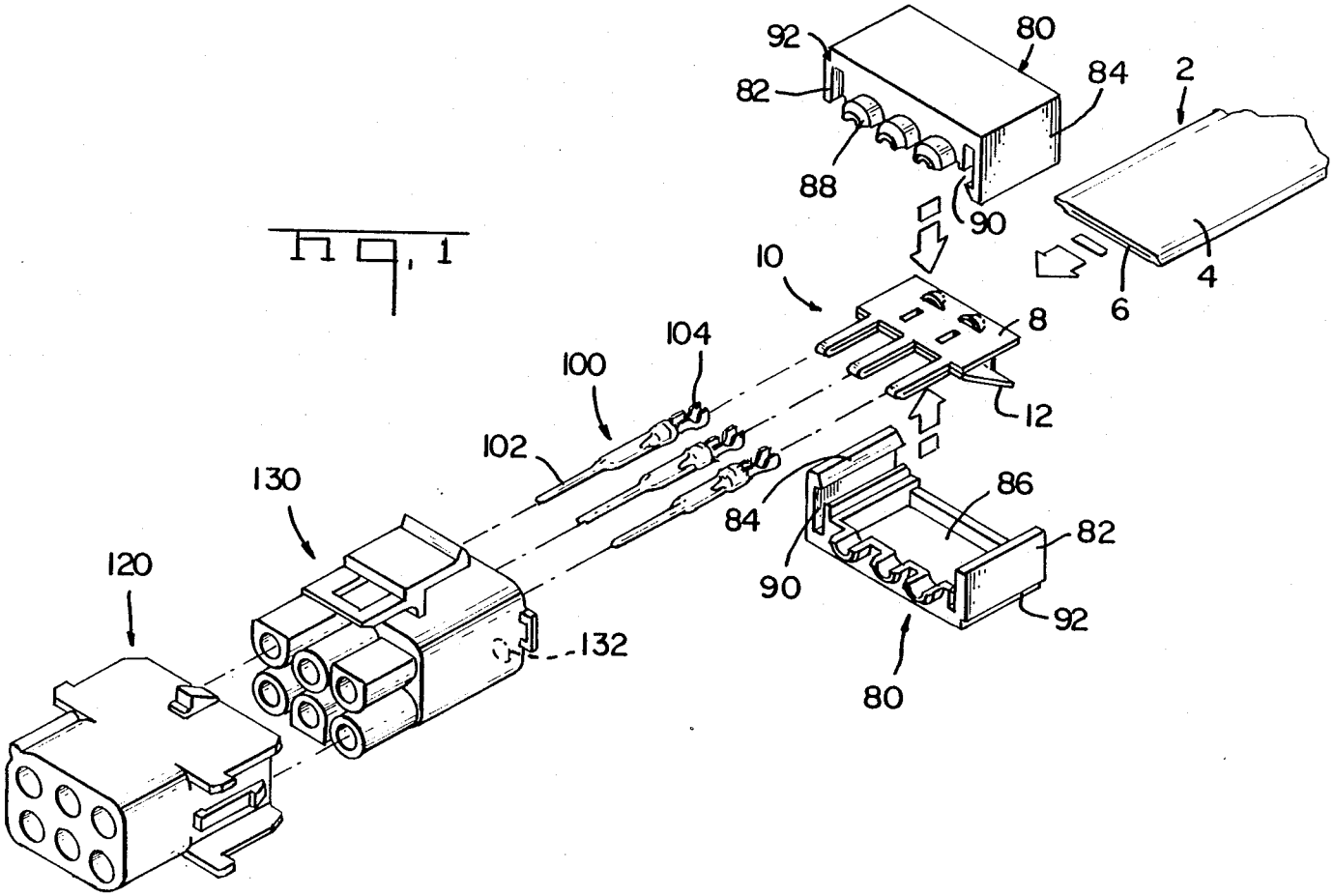
FIG. 1 is an exploded perspective view of an assembly incorporating the adapter member of the instant invention.

The thrust of the instant invention relates to the utilization of flat conductor cable as a means for power distribution, yet providing the versatility of tailor made power distribution systems. The preferred embodiment of the cable includes an insulated cable 2 as shown in FIG. 1, including a flat conductor 6 with insulative material extruded or laminated therearound. The preferred embodiment of the flat cable includes a flat conductor of copper or aluminum material with 4–8 mils of an insulative material such as Tefzel extruded therearound. ("Tefzel" is a Trademark of the E. I. Dupont de Nemours and Company). The preferred embodiment of the instant invention is for use with d.c. power under 36 volts, at a current rating of 100 amps, although the instant invention is also adaptable for use with a.c. power. The significance of the instant invention also relates to the fact that a first cable, or primary power rail, could carry a current equal to the full capability of a power source, while other cables, or secondary power rails, can be spliced off of the primary power rail and distribute current at lower levels. The availability of the flat power cable as a versatile power distribution system has ben captured by the inception of a plurality of adapter members which are electrically and mechanically interconnectable to the flat conductor cable by means of insulation displacement technology. These adapter members are interconnectable to the cable by means of conventional hand tools to further the versatility of the power distribution system. Thus, with the plurality of adapter members which have been devised, a myriad of power distribution systems are available, limited only by the imagination of the electrical designer. The invention will now be described in further detail by reference to the various figures.

Referring first to FIG. 1, an assembly is shown including an adapter 10 poised for receiving the flat power cable 2. Hermaphroditic cover members 80 are also exploded above and below the adapter 10 for insulating the adapter member. The adapter member 10 is also shown poised for receiving electrical contact members 100 at an interconnection end, which will be disposed in the connector plug portion 130. In this manner, the current within the power distribution cable 2 is divided into separate paths for individual distribution to other areas of the electrical system requiring the power. The contacts 100 can then be installed within the connector plug portion 130 for matable and unmatable interconnection to a mating socket portion 120. It should be understood however, that the adapter 10 is not limited to any one type of electrical connector, but rather may be used with any connector having contacts with wire crimp sections, such as sections 104, of contacts 100. Furthermore, the adapter is not limited for use with a connector at all, but may be used to interconnect to an electrical article such as a power bus, a printed circuit board, or the like, as will be disclosed later more fully.

Figure 4:
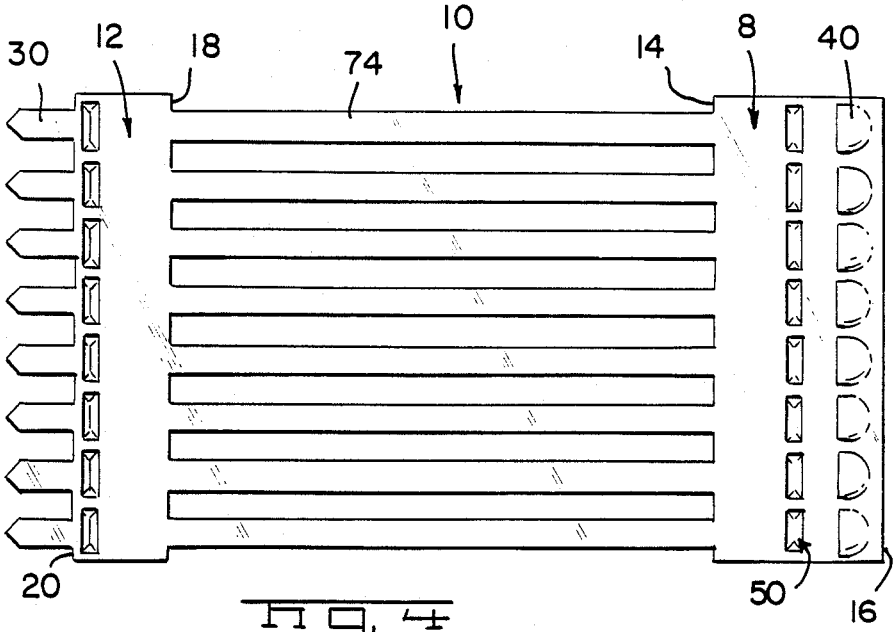
FIG. 4 is a plan view of the flat blank stamping of the instant invention.
Figure 5:
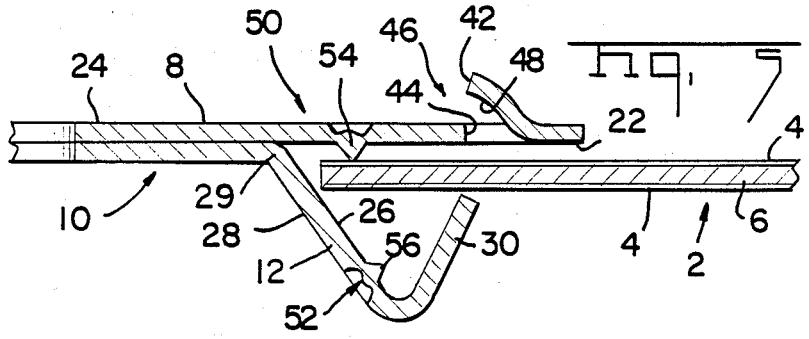
FIG. 5 is a cross-sectional view through lines 5—5 of FIG. 3.

Referring now to FIGS. 4 and 5, the adapter member 10 is shown in greater detail. The adapter member is stamped from a flat blank as shown in FIG. 4. The adapter member 10 generally includes a termination or insulation displacement end including first and second cable-proximate portions such as first and second plate members 8 and 12, with integral sections 74 extending therebetween. The plate member 8 includes an inside edge 14, and a back edge 16, and as shown in FIG. 5, an inside surface 22 and outside surface 24. The plate member 8 further includes arcuate guide members 40 and barbs 50 stamped and formed therein. Referring still to FIG. 5, the arcuate guide is shown more clearly. The arcuate guides are formed by stamping the plate member 8 in a direction normal to the plane of the plate member 8 forming two sheared edges 42 and 44, and then forming the portion between the sheared edge 42 and the back edge 16 to define an arcuate configuration, or a spherical wedge having an interior guiding edge 48. The forming of the arcuate guide 40 defines a window 46 which faces outwardly towards the interior edge 14 and towards the members 74. Still referring to FIG. 5, the barb 50 is shown as including a pointed portion 54 extending from the inside surface 22 of the plate member 8. The pointed portion is formed by a die having sidewalls of a triangular configuration forcing the material into a triangular pointed end 54.

Referring again to FIG. 4, the adapter member 10 further includes a second plate member 12 having an inside edge 18 and an outside edge 20. The members 74 are contiguous between the plates 8 and 12, extending from respective inside edges 14 and 18. The plate 12 further includes insulation displacing lances 30 extending from the forward edge 20 of the plate member 12. Plate member 12 also includes barbs 52 stamped and formed from an outside edge 28 inwardly towards an inside edge 26, to form a pointed section 56, as best shown in FIG. 5.

The preferred embodiment of the adapter 10 includes a flat blank as shown in FIG. 4 which is folded over such that the members 74 are doubled over upon one another to form adapter members 70, as best shown in FIG. 3. The adapter is comprised of a soft material which is formable into a tight radius such as radius 72 shown in FIG. 3, which allows the members 74 to be folded in half defining members **74*a* and 74*b* as shown in FIG. 3. By using a material which is soft enough to form a tight radius 72, members 74*a* and 74*b* can be flush against one another. This defines the profile of the adapter segments 70 into a small envelope for which a contact may be wrapped around and crimped to. Furthermore, it provides for electrical continuity between the segments 74***a* and 74*b* allowing for maximum current through the segments.

The members 74 are folded over upon their entire length but plate member 12 is formed to extend downwardly from transverse bending region 29 and diverging with respect to plate 8, while the insulation displacing lances 30 integrally joined to second plate section 12 are formed to extend upwardly towards the plate 8, as best shown in the cross-section of FIG. 5 with lances 30 aligned with and spaced from bending region 29. This directs the insulation displacing lances 30 towards the arcuate guides 40 from the inside surface 22 of the plate member 8, yet allows a spacing between the end of the lance 30 and the inside surface 22 of the plate member 8, for receiving between them the flat power cable 2 as shown in FIGS. 3 and 5. The initial spacing between ends of lances 30 and inside surface 22 defines a cable-receiving aperture or cable entry for receiving an end or edge portion of flat cable 2.

Figure 6:
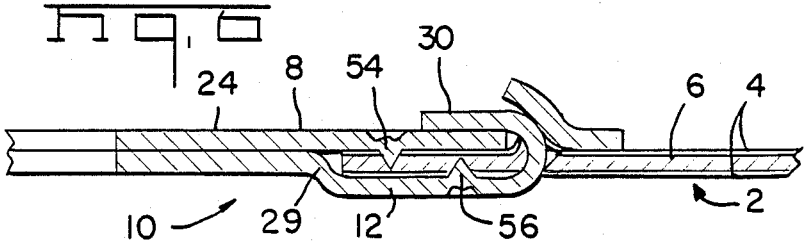
FIG. 6 is a cross-sectional view through lines 6—6 of FIG. 2.

To install an adapter member 10 to a flat power cable 2, the flat cable is placed in the cable entry between the end of the lance 30 and the inside surface 22 until the end of the flat cable 2 abuts the interior surface 26 of the plate 12 with major surfaces of flat cable 2 being adjacent inside surfaces 22,26 of plates 8,12. The adapter member 10 and the conductor are then placed in a die or in a hand tool which has platens with arcuately shaped recesses, which will cooperate with and back up the arcuate guide 40. The diverging portion of plate member 12 is then rotated about bending region 29, and the insulation displacing lances are pressed upwardly towards the flat plate 8, and each of the lances 30 pierce through the conductor 6 at different lateral locations. The lances generally have a length at least three times greater than the thickness of cable 2, and the end portions protruding beyond the cable are then forced into the arcuate guides until the end of the lances contact the inside radiused surface 48, curling the lance 30 around the radius 48 and through the window 46 projecting the lance in an opposite direction. The insulation displacing lance is then forced against the outside surface 24 of plate 8, until it abuts the surface 24. The lances hold the plate members 8 and 12 fixedly against the cable member 2, which causes the pointed barbs to penetrate through the insulation 4 and partially into the conductor 6, a first set of barbs 50 from the upper side and a second set of barbs 52 from the lower side, as shown in FIG. 6. The connection between the lances and the conductor 6 also forms a gas tight connection between the conductor 6 and the adapter 10, which prevents any galvanic corrosion between the connection due to the dissimilar metals.

The adapter 10 is preferably made from a material which is hard enough to maintain its rigidity in the areas such as the barbs 50, 52 and the lance 30, yet as mentioned above, ductile enough to form the radius 72 at the end of the adapter sections 70. Furthermore, the material must have high electrical and thermal conductivity in order to carry high currents with minimal temperature rise. The preferred material to accomplish the above mentioned characteristics was found to be hard iron copper. After the adapter 10 is applied to the flat cable 2, the adapter 10 can be used to interconnect the flat cable to a plurality of pin contacts similar to those shown in FIG. 1 as 100, or to a plurality of socket contacts such as those shown in FIG. 2 as 106. The adapter segments 70 would, in effect, simulate round conductors to which the contacts may be crimped. The pin contacts 100 shown in FIG. 1 have conventional wire crimp portions 104, and the socket contacts 106 shown in FIG. 2 have conventional wire crimp portions 108 for crimping around the segment portions 70 for electrical connection thereto. The adapter sections 70 may also be plated with solder to assist in the connection to the contacts which would require a further process such as reflow, or infrared heating to solder the wire crimp portions 104, 108 to the adapter segments 70.

The adapter 10 would then be partially enclosed within an insulation barrier 80 such as that shown in FIG. 1, to electrically isolate the power connection from other electrical connections within the system. The hermaphroditic halves 80 include latch members 84, cavities 90, upstanding walls 82 and a recessed floor 86. The flat cable 2 and the attached adapter 10 are insertable into the halves 80 such that the plates 8, 12 lie adjacent to the recessed floors 86. The halves are latched together by inserting the wall 82 of the upper half within the cavity 90 of the lower half, and likewise the wall 82 of the lower half 80 into the cavity 90 of the upper half. The halves are compressed towards each other until the shoulders 92 located on respective walls 84 are latchably retained beneath the latch member 84. As assembled, the halves 80 totally surround the plates 8, 12 yet allow a portion of the adapter members 70 to project beyond the forward bosses 88. This allows the length of the contact 100 to be fully inserted within the housing 130 and the forward bosses 88 to be partially inserted within the aperture 132 of the connector member 130, allowing total insulation around the contacts 100 and around the adapter member 10.

As shown in FIG. 1, the pin contacts 100 and the adapter member 10 are insertable into an insulative housing of the type shown as 130. The connector plug portion 130 and socket portion 120 are of the type shown generally in U.S. Pat. No. 4,443,048. It should be understood that the pin contacts 100 do not have to be specially made to fit the adapter 10, but rather the adapter simulates the conductor of a wire to which the contacts are normally connected. In other words, if the wire crimp portions 104 of pin contacts 100 are normally sized for connecting to 10–12 gauge conductors, the adapter 10 can be made such that members 70 simulate 10–12 gauge conductors to match the wire crimp portions 104 of the pin contacts 100. It should be further understood that the adapter member is not limited for use with the pin contacts of U.S. Pat. No. 4,443,048, or with contacts for 10–12 gauge conductors, but rather can be made to simulate any size conductor and can be used to interconnect to any contact which uses wire crimps. When the pin contacts are inserted in the connector housing the bosses 88 of the insulative cover partially extend into the connector housing 130 preventing any possible shorting between the contacts and other members of the electrical system.

With a connection system so installed the adapter member provides for a versatile power distribution system. The receptacle portion 120 could include socket contacts similar to those shown in FIG. 2 as 106 for contacting the pins 100. The socket contacts could in turn have a second adapter member 10 and could merely be a splice between two segments of power cable. Alternatively, the socket contacts could be connected to discrete wire for the distribution of power to other areas within the system.

Another possible application of the above described adapter includes interconnection to a pin field via an electrical connector interconnectable to the pins. Power is typically fed into the daughter cards via wire wrapped around posts of a connector of the type shown in U.S. Pat. No. 3,348,191. Wire wrapping involves a significant expense in machine tooling which can be eliminated by utilizing the techniques of the adapter member 10, of the instant invention.

The adapter member 10 would be used for interconnection of the flat power cable 2 to an electrical connector of the type shown in U.S. Pat. No. 3,393,224. This connector, otherwise known as the Ampmodu (trademark of AMP Incorporated, Harrisburg, Pa.), includes a box type contact having a crimpable portion which would crimp to the adapter. In this manner, the connector would be connectable to the posts of the daughter card connector, thereby, eliminating the cost of applying the wire wrapped conductors.

As mentioned previously, the adapter member can be profiled for use in applications other than those requiring contacts within a connector housing. For example, and referring to FIG. 7, the adapter member 210 can be used for interconnecting a flat cable 2 to a plurality of receptacles 112, otherwise known as Assignee's Faston® receptacles. The receptacles 112 are then interconnectable to Assignee's Faston® tabs (not shown). The receptacles and tabs are of the type generally shown in U.S. Pat. Nos. 2,774,951; 2,791,755 and 2,888,662; the disclosures of which are incorporated herein by reference. In order to interconnect the wide receptacles and still maintain the same electrical interconnection integrity, that is the same number of insulation displacing lances and barbs, the adapter member has half the number of adapter segments 270. Otherwise, the plate members 208 and 212 are identical to the plates 8 and 12 described above.

Figures 8, 9A, 9B:
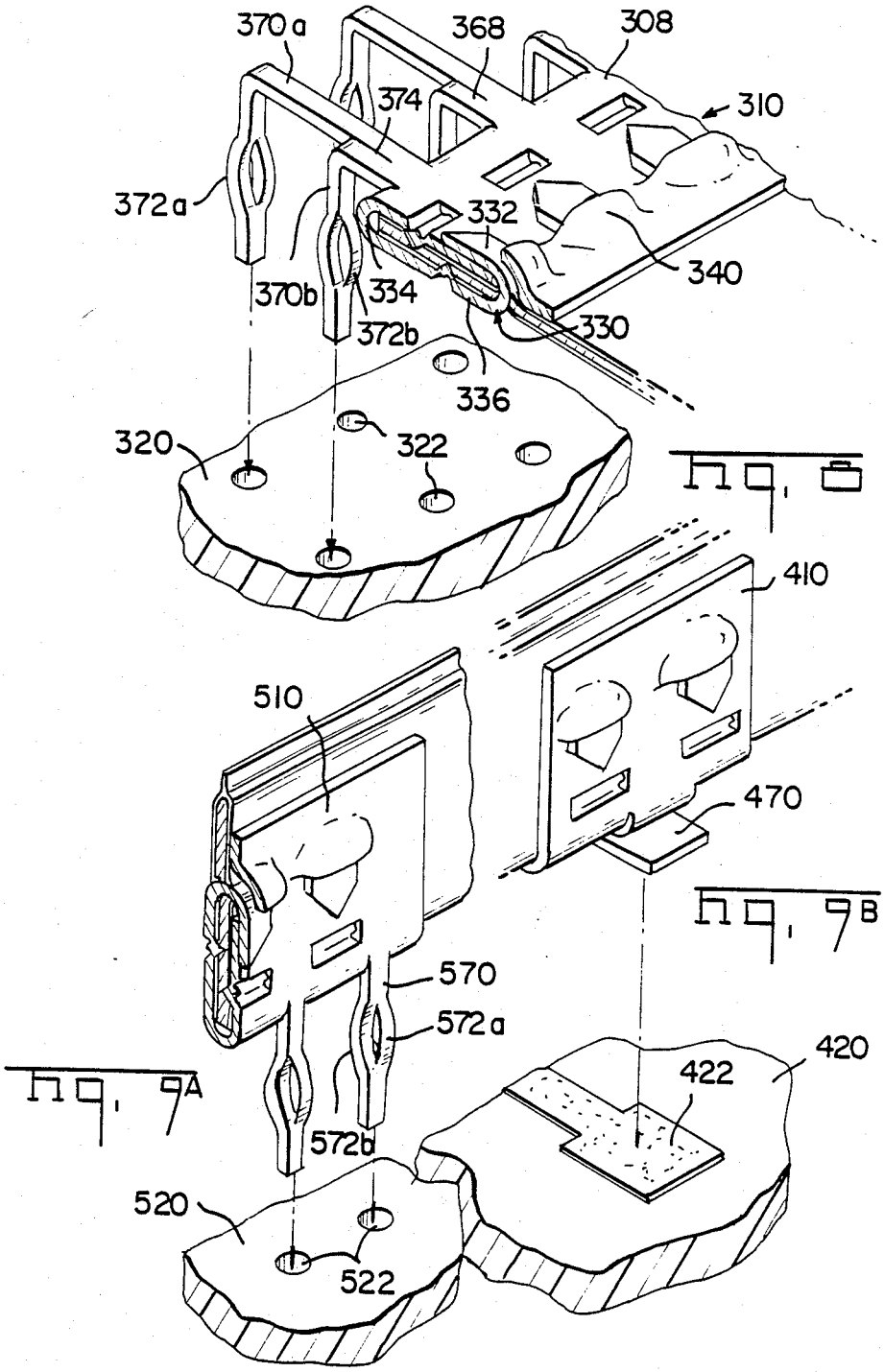
FIG. 8 is an alternate embodiment of the instant invention for right angled mounting to printed circuit board through holes.
FIG. 9A is an alternate embodiment of the instant invention showing a straight leg for direct mounting in printed circuit board through holes.
FIG. 9B is an alternate embodiment for surface mounting to a printed circuit board.

FIGS. 8, 9A and 9B show alternate embodiments of adapter members which are capable of interconnecting power via a flat cable 2 to printed circuit boards, These adapter members are also capable of distributing power to or from solid metal rails or beams, such as power busses (not shown). FIG. 8 shows an embodiment for right-angled interconnection to printed circuit boards or solid metal rails having a through hole configuration. The adapter 310 includes a flat plate 308 with segments 368 extending from a front edge thereof. Since the segments 368 are of a single thickness, there is not continuous flat plate on the underside of the cable 2, rather insulation displacing lances 330 are bent around the flat cable at radius 334 and lie adjacent to the cable at 336 where the lance end 332 protrudes through the arcuate guide 340 as similarly disclosed in previous embodiments. For interconnection to the printed circuit board 320, the adapter 310 includes individual press-in legs **370*a* and 370*b*, each leg extending from a portion 368 and formed along a common shear line 374. For interconnection to the through holes 322 of the printed circuit board 320, the adapter member 310 further includes stamped and formed legs 372*a* and 372*b*, otherwise known as Assignee's Action Pin®, U.S. Pat. No. 4,186,982, the disclosure of which is incorporated herein by reference. The legs comprise a sheared section along the longitudinal length of the tine, each leg 372*a* and 372*b*** being formed in opposite and transverse directions from the tine to form a compliant section for interferingly fitting within a through hole.

FIG. 9A shows a similar printed circuit board interconnection, adapter 510 including straight legs 570 and legs **572*a* and 572*b*, for interconnection to through holes 522 of printed circuit boards 520. Similarly, FIG. 9B shows a configuration of an adapter 410 having a tab member 470 for surface mounting to a solder tab 422 on a printed circuit board 420. FIGS. 9A and 9B** also show that the adapters can be interconnected to the sides of the flat cable, not just to the ends of the cable. This allows current to tapped off of the cable for distribution of the current remote from the cable, without terminating the cable; rather the flat cable can continue to distribute power throughout the parts of the electrical system and still have power distributed through the cable.

The configurations shown in FIGS. 8 and 9A show that, in addition to and instead of interconnection to a printed circuit board, the adapters 310 and 510 can also be used for interconnection to a power bus. Often, a power bus includes a thick conductive member, such as copper, which carries a voltage potential. One bus member would be a positive polarity while a second bus would be a negative polarity. By simply drilling holes into the bus members, the press-in legs **370*a*, 370*b* or 570 could be inserted into the drilled holes for interconnection thereto. One power cable with press-ins would be interconnected to the power bus having the positive polarity for the source voltage while a second power cable with press-ins would be included within the circuit and be connected to the power bus having the negative polarity of the return line. The flat cable would then be routed throughout the electrical network, by means such as the connector system as shown in FIG. 1**, to continue with the distribution of the power.

Figure 10:
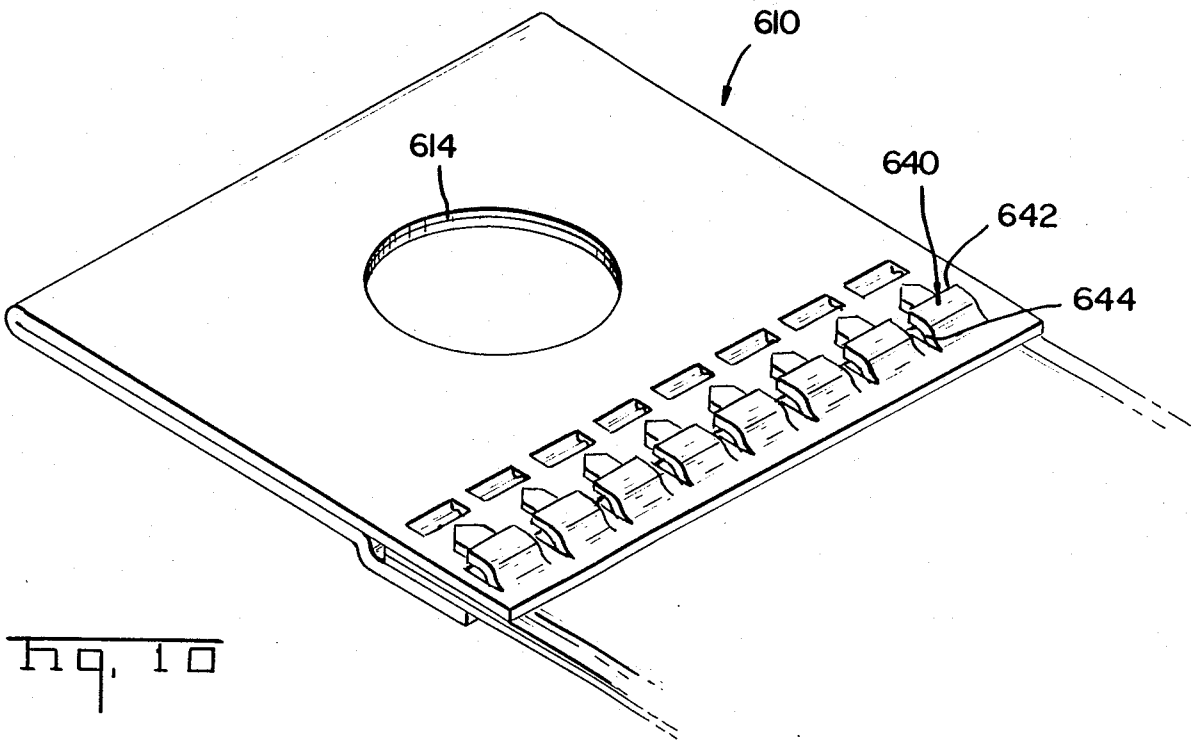
FIG. 10 is an alternate embodiment of the instant invention having a through hole for direct mounting.

FIG. 10 shows another alternate embodiment which contains a through hole for interconnection to a barrier block or the like, where the barrier block contains two binding screws within a common conductive terminal. The adapter 610 could be used to splice two power cables or could be a transition between flat and round cable. FIG. 10 also shows an alternate arcuate guide which could be incorporated on any of the embodiments. This arcuate guide is especially useful in a situation where the centerline spacing between the arcuate guides is small, as the arcuate guides 640 can be placed on closer centers than the arcuate guides which are dome shaped, due to the radiused sidewalls on the domes.

Figures 11A, 11B:
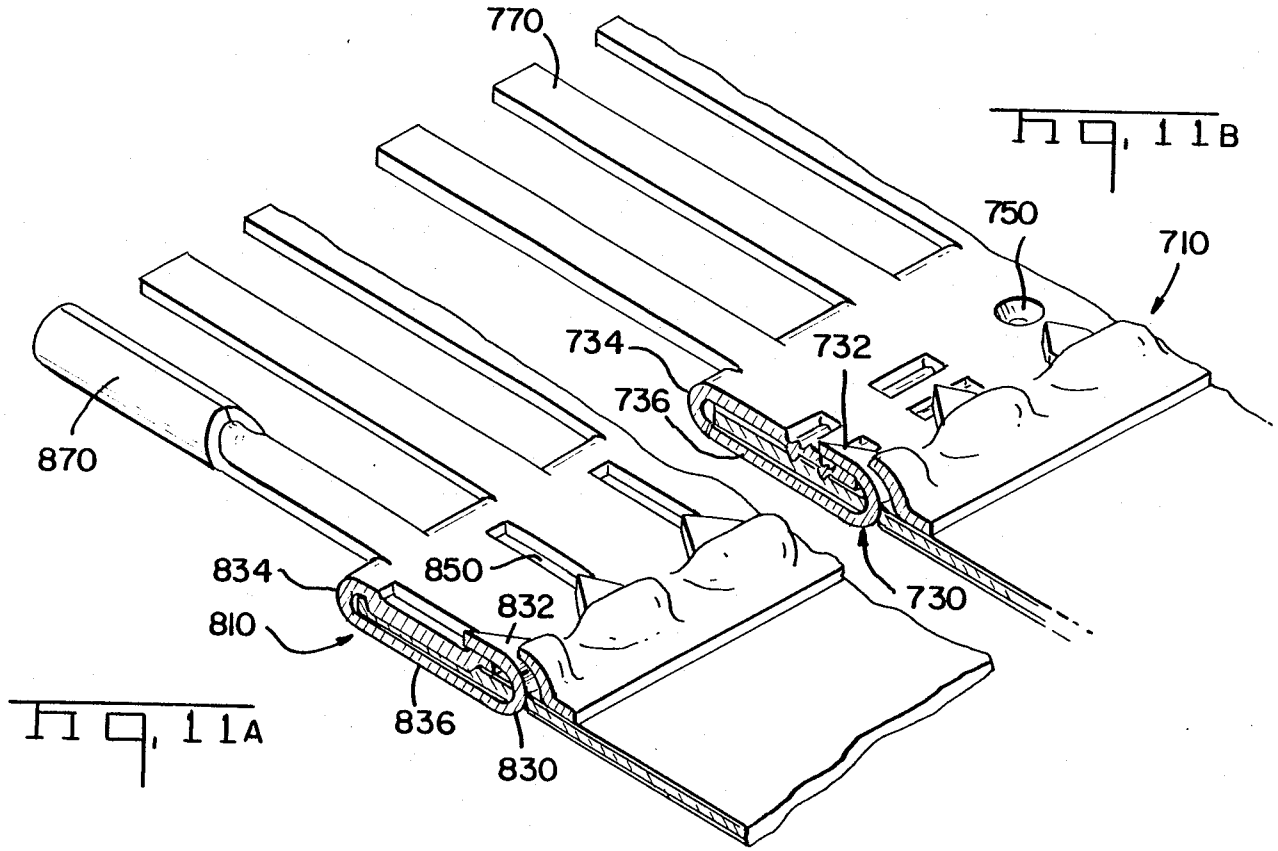
FIG. 11A is an alternate embodiment showing possible rolled pin ends and alternate lances.
FIG. 11B is an alternate embodiment showing the possible single thickness adapter segment and possible round lances.

FIGS. 11A and 11B show embodiments 710, 810 having adapter segments with a single thickness of metal rather than a folded over member. This embodiment is similar to the embodiment shown in FIG. 8 in that there is no lower plate adjacent to the cable 2. Rather, as shown in FIG. 11B, the radiused portion is between the adjacent tines 770 at 734 and the lance 736 actually lies adjacent to the cable. The embodiment of FIG. 11A is similar to that shown in FIG. 11B with radius 834 and lance 836, substantially similar to the radius 734 and lance 736 of FIG. 11B. The embodiment of FIG. 11A shows that the adapter segments could better simulate round conductors by rolling the adapter members to form a tubular adapter member 870. FIGS. 11A and 11B also show that the barbs could be circular as shown as 750 in FIG. 11B, or could be disposed parallel to the adapter members as shown as 850 in FIG. 11A.

Figures 12A, 12B:
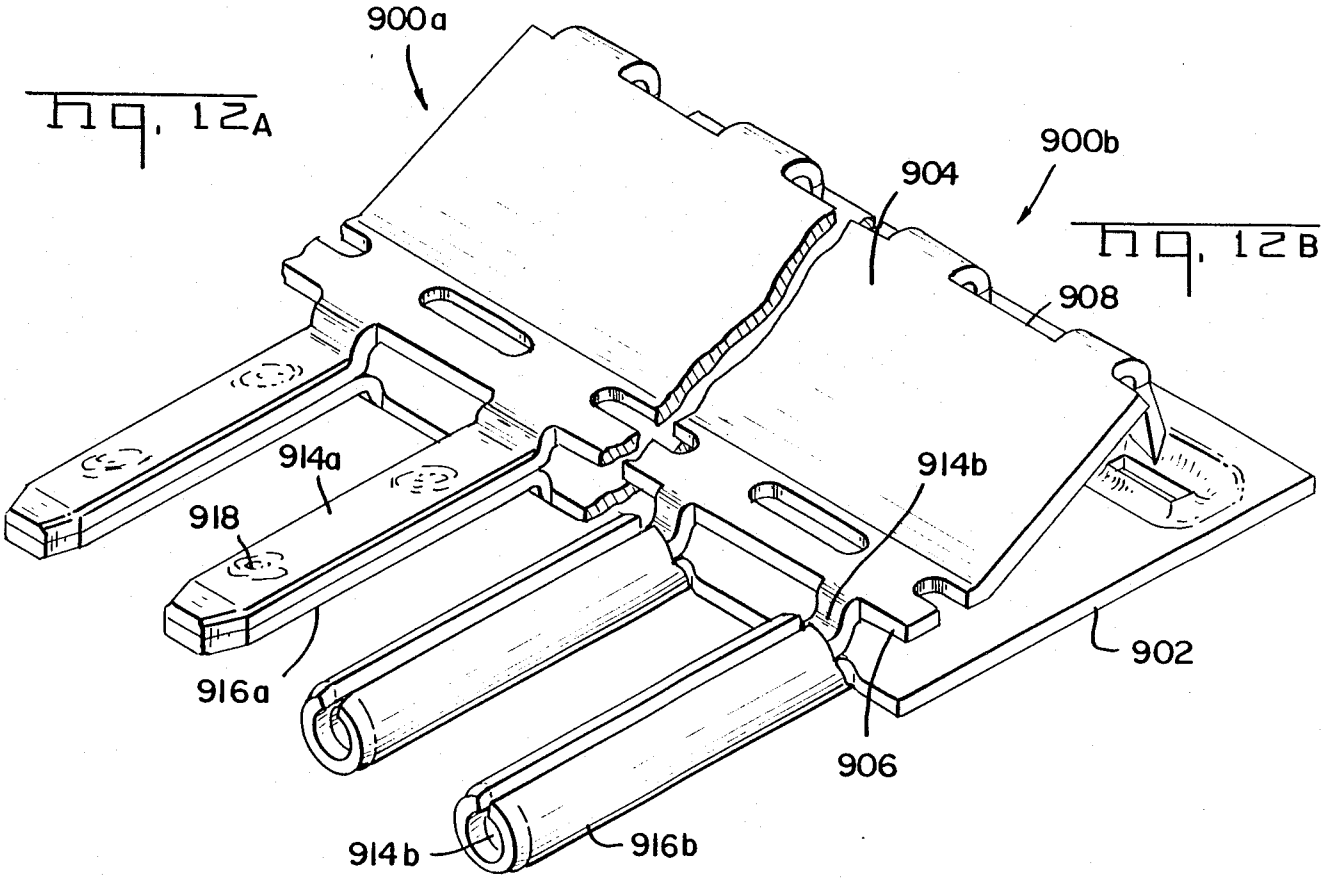
FIG. 12A is an isometric view of an alternate embodiment of the adapter member.
FIG. 12B is an isometric view similar to that of FIG. 12A showing the ends of the lower tines rolled around the upper tines.
Figure 13:
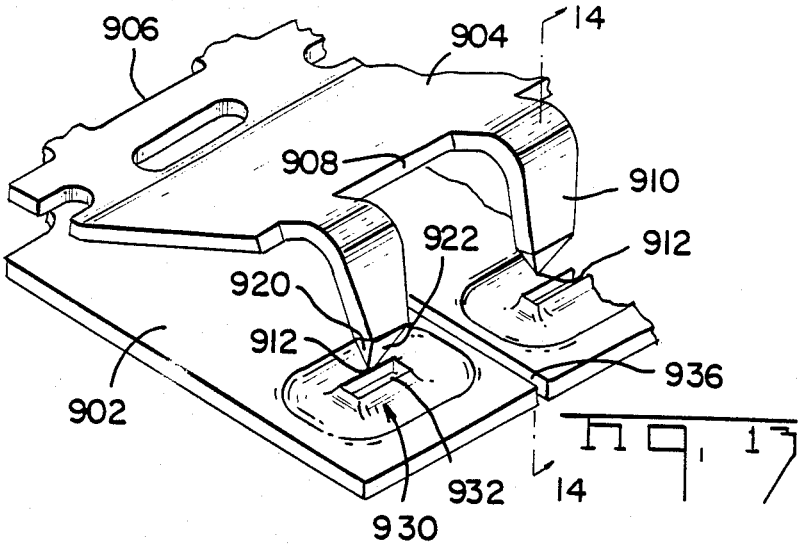
FIG. 13 is an isometric view of the insulation displacement portion of the embodiments of FIGS. 12A and 12B.

FIGS. 12A through 15 show a first alternate embodiment of the adapter member. Referring first to FIGS. 12A and 12B the adapter members **900*a* and 900*b* include similar insulation displacement portions but have different tine portions. Each of the embodiments shown in FIGS. 12A and 12B** are comprised of two stamped blanks interconnected at the tine sections.

Figure 14:
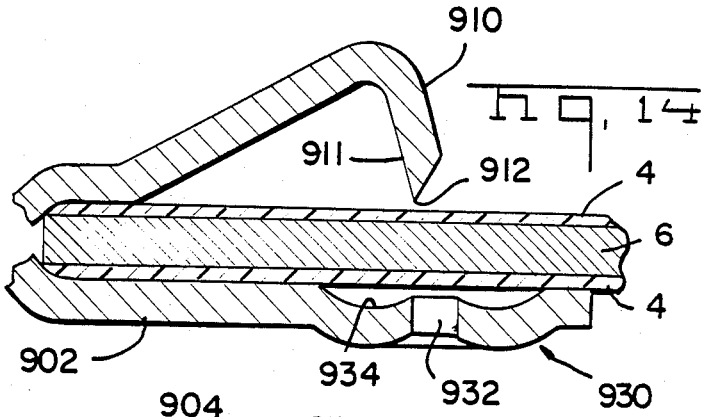
FIG. 14 is a cross-sectional view taken through lines 14—14 of FIG. 13, showing the flat cable in place.

The insulation displacement section includes a plurality of insulation displacing lances 910 extending from the rear edge 908 of the upper plate section 904 in combination with a die section 930 positioned in the lower plate section 902 directly below the insulation displacing lance. The die section includes a rectangular opening 932 therein which is profiled to interferingly accept the insulation displacement lances. The rectangular opening 932 is surrounded by a radiused trough 934 (FIG. 14). The lances include upwardly sloping edges in two dimensions, edges 920 and 922 which define a point 912.

In operation the point 912 punctures the insulation at one corner and then propagates a shearing of the Tefzel insulation in two directions as the lances further penetrate through the rectangular opening. It should be understood that the Tefzel insulation is very tough and very ductile, thus the insulation must be punctured. Otherwise the insulation stretches with the lance as it progresses through the conductor thereby insulating the conductor from the lance. The rectangular opening is designed smaller than the lance in order to create a tool and die effect thereby generating higher shearing forces by concentrating the force around the edge of the rectangular opening. The primary electrical connection will be between the front edge 911 of the insulation displacing lance and between the conductor 6.

Figure 15:
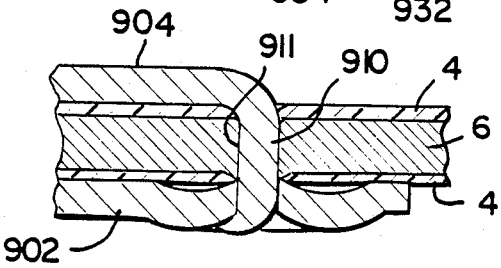
FIG. 15 is the cross-sectional view of FIG. 14 showing the insulation displacement lances in the assembled condition.

After the lance projects through the rectangular opening 932, the point is thereafter curled towards the front end of the adapter under the radiused portion, as shown in FIG. 15. This causes the die portion 930 to be raised upwards with respect to the radiused trough and towards the cable insulation, as shown in FIG. 15. The die portion is actually designed to be deflectable, the radiused trough assisting in the ability of the die portion to deflect upwardly. Deflection of the die portion upwardly tends to create a constant tension on the lance 910, thereby storing energy in the lance and die portion combination, assuring a gas tight electrical connection between the lance and the primary electrical connection. The upward deflection of the die portion 930 is further assisted by including gaps 936 (FIG. 13) between adjacent die portions from each other.

Referring now to FIGS. 12A and 12B, the tine portions are shown in greater detail. Referring first to FIG. 12A, the tine is comprised of an upper tine portion **914*a* extending from the upper plate portion 904 and a lower tine portion 916*a* extending from the lower plate portion 902. The upper tine member 914*a* and the lower tine member 916*a* are equally dimensioned to overlie one another. The upper and lower tine members 914*a* and 916*a* are interconnected via spot welded portions 918**.

Figure 2:
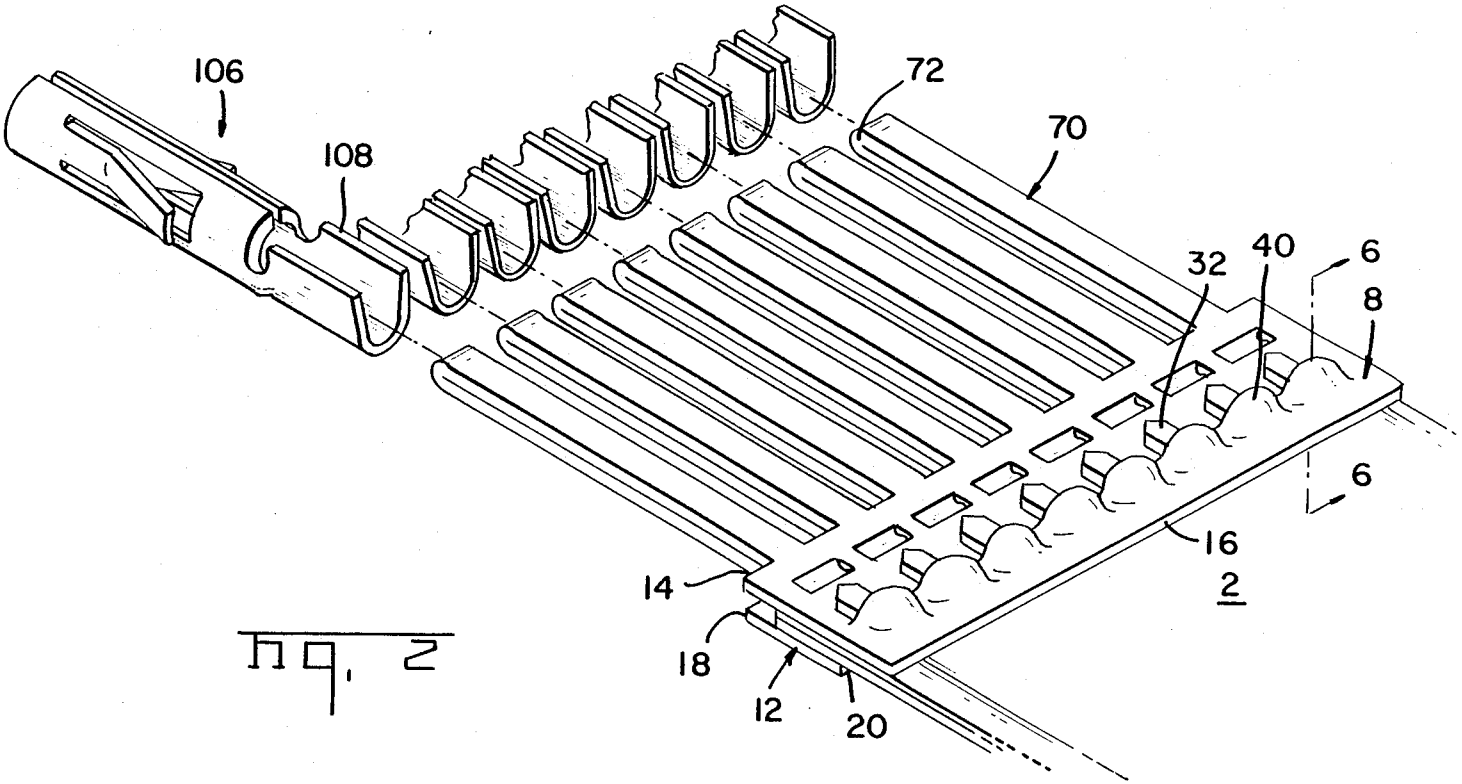
FIG. 2 is a perspective view of the adapter member in a crimped configuration of a flat cable.
Figure 1:
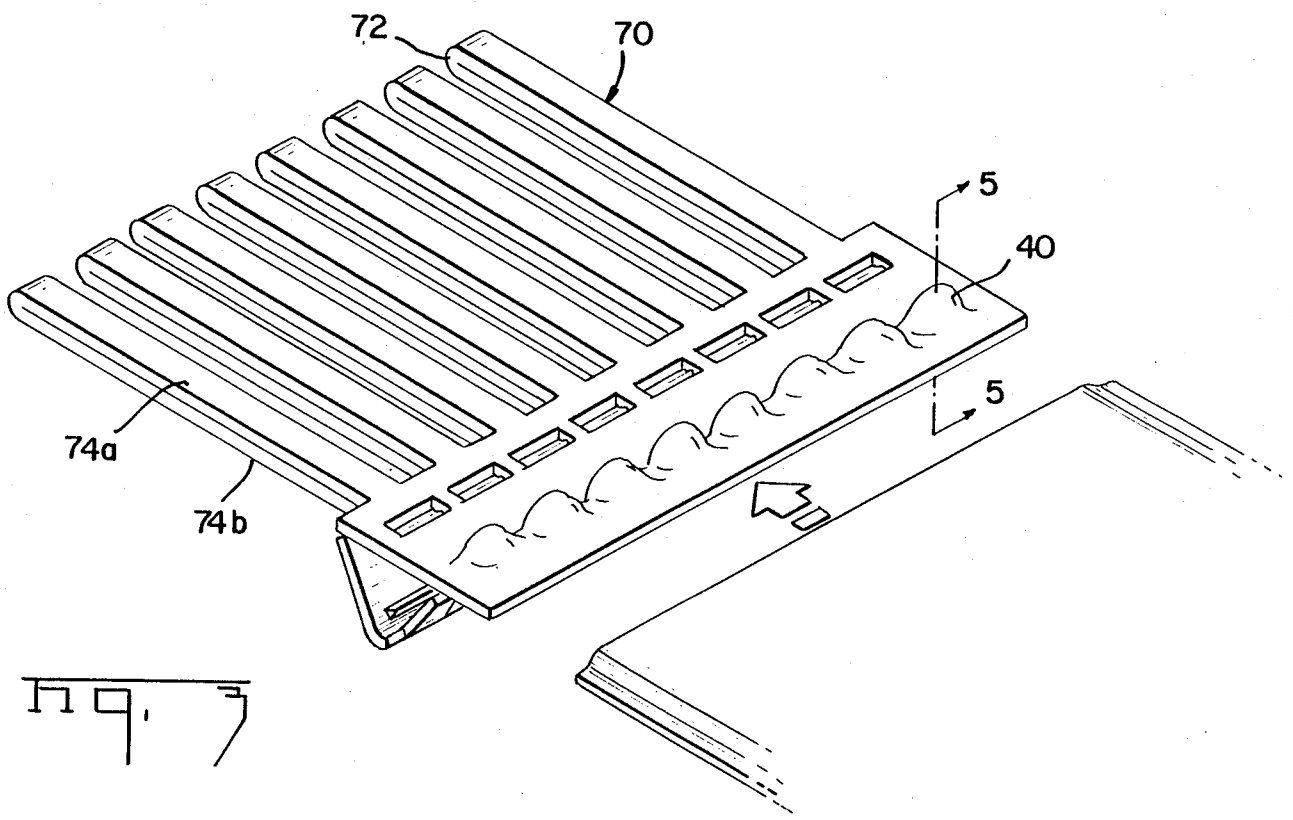
Figure 7:
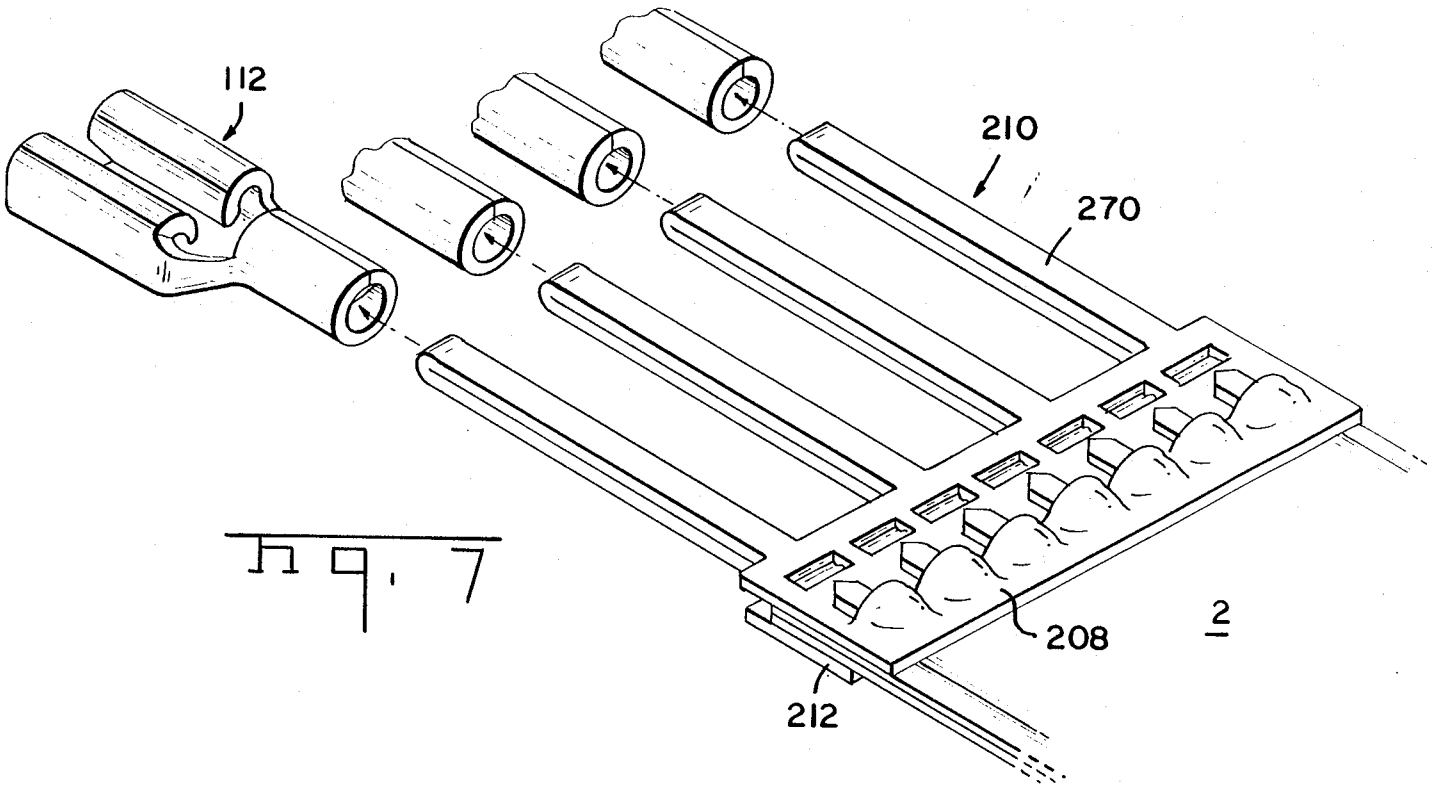
FIG. 7 is a perspective view of an adapter member with adapter segments on different centerline spacings.

Referring now to FIG. 12B, the tine is comprised of an upper and narrow tine portion **914*b* and a lower and wide tine portion 916*b*. The lower tine portion 916*b* is profiled to overlappingly surround the upper tine portion 914*b* and be crimped thereto. Each of the tine portions shown in FIGS. 12A and 12B are profiled for receipt within the terminal crimp portions previously described, and as shown in FIGS. 1, 2 and 7**.

An advantage to the adapter member shown in FIG. 12A through 15 is that, if desirable the upper and lower blanks can be comprised of different materials, or of the same material having different material characteristics. The preferred embodiment would include an upper blank which is comprised of a harder material while the lower material, which must be deformed, is comprised of a softer material, for example the upper blank could be full hard iron while the lower blank is half hard iron.

Figure 16:
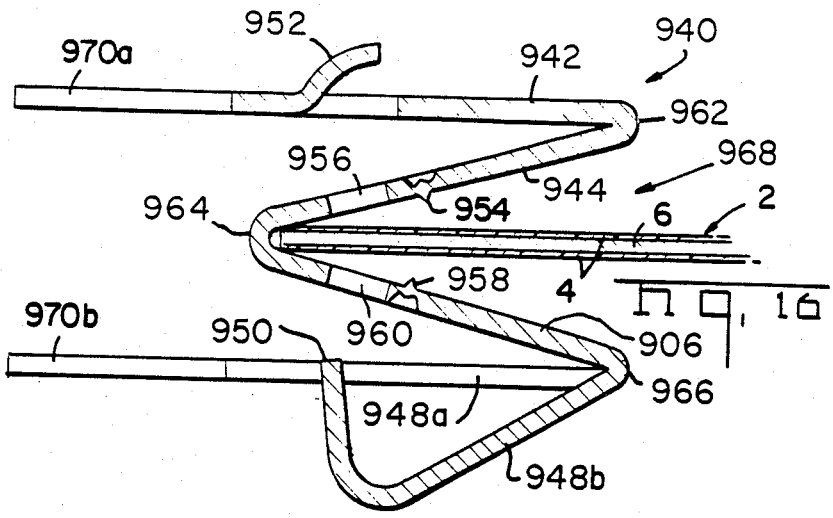
FIG. 16 is a cross-sectional view of a second alternate embodiment adapter member in an unconnected position.
Figure 17:
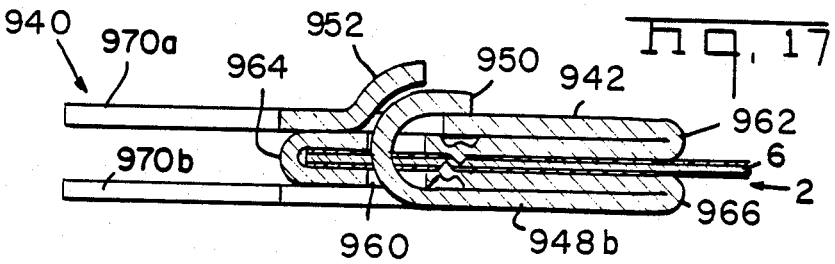
FIG. 17 is similar to the cross-sectional view of FIG. 16 in a connected configuration.
Figure 18:
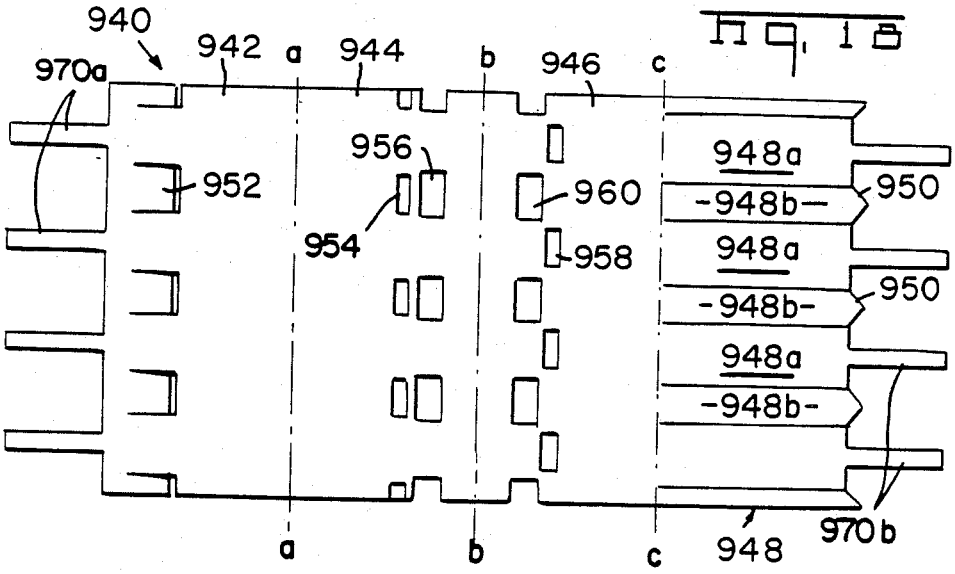
FIG. 18 is the flat metal blank of the embodiment shown in FIGS. 16 and 17.

FIGS. 16, 17 and 18 show a second alternate embodiment of the adapter member. As best shown in FIG. 18, the stamped blank of the adapter member shows that the adapter member comprises generally four plate members 942, 944,946, and 948, plate member 948 being further divided into individual plate members **948*a* and 948*b*. Members 948*a* include at their ends adapter segments 970*b*, while member 948*b* have extending from their ends lance portions 950. FIG. 18 also shows the potential fold lines a—a, b—b and c—c about which the stamped blank will be formed. Plate member 942 includes arcuate guides 952 and adapter members 970*a*. Plate member 944 includes barbs 954 and window 956 which is a stamped out hole completely through the material. Plate member 946 includes barbs 958, and a second set of windows 960 which are opposed from the windows 956** and equally spaced away from the bend line b—b.

When the adapter member 940 is formed into the configuration shown in FIG. 16, the adapter 940 is formed into an M-shaped configuration with radius 962 about lines a—a radius 964 about lines b—b and radius 966 about lines c—c. As formed into the configuration shown in FIG. 16, the plate members 942 and **948*a* are in parallel relation with one another, and the plate members 944 and 946 form an opening 968 for the cable 2 to be received therein. Also as shown in FIG. 16, the member 948*b* is bent downwardly from member 948*a* with the lance portion 930 bent upwardly towards plate member 946. It should be noted that the arcuate guide 952, the window 956 and the window 960 are each vertically aligned, and lance portion 950 is vertically aligned with and disposed directly below window 960**.

The cable 2 is received within the receiving area 968 until the cable abuts the radiused portion 964. The adapter member 940 can then be subjected to a die or hand tool to terminate the cable within the adapter 940, to the configuration shown in FIG. 17. As terminated, the lance portion 950 projects through window 960, then through the cable 2, then through window 956 and then conforms to the arcuate guide 952 as discussed in previous embodiments. When the cable is fully terminated the cable and adapter will conform to that as shown in FIG. 17. As with other embodiments, the plate members store energy which will provide a constant force on the barbs against the cable conductor, again providing a gas tight connection. It should be noted that the adapter 940 can take a single layer of cable and provide a double row of adapter members **970*a* and 970*b*** for receiving terminals thereon.

The above described adapter members when used in conjunction with a flat conductor cable, provide for a versatile power distribution system. The flat cable can be interconnected to a power bus by means of one of the press-in type adapters disclosed herein. The cable can thereafter be routed to other parts of the electrical system furnishing the power throughout the system. At any point along the system, one of the above disclosed adapters may be interconnected to the side edge of the flat cable tapping a portion of the power off, leaving the cable and the remainder of the power undisturbed for continuation throughout the electrical system. The power may be distributed by means of an adapter connected to electrical terminals as shown in FIG. 1, and thereafter routed through electrical connectors. The power can also be distributed by means of tabs and receptacles as shown in FIG. 7. The adapter members can also be in the form of printed circuit board connections as shown in FIGS. 8, 9A and 9B. The force required to crimp the adapters through the flat cable are low enough that the adapters can be installed with hand tools, resulting in an easily installed system. As the power distribution system utilizes flat cable as the main conduit of power distribution, the adapter members significantly reduce the labor intensity of routing power, when compared to the labor required to route round discrete wire.

For example, in a field application where two connectors are used for interconnecting ten parallel discrete wire, twenty crimping operations are required, which includes stripping ten wires and crimping ten contacts to the prepared ends of the wires. When using the above described adapter with flat cable, twenty-two termination operations are required, but twenty of the operations, those involving the crimping of the contacts to the adapter members, can be preassembled by automatic assembly machines, leaving only two termination operations, the adapter to the cable, for field termination. Furthermore, as the adapter 10 is utilized with flat cable, the preparation of the individual wires is eliminated.

The embodiments shown herein are exemplary of the possible embodiments and should not be taken to limit the scope of the claims which follow.

What is claimed is:

1. An adapter which is electrically and mechanically connectable to a flat insulated power cable and is matable and unmatable with another electrical article for distributing electrical power throughout an electrical system, comprising:

a termination end connectable to said cable having plate means comprising at least opposing first and second plate members each with an inside and outside surface, said first and second plate members being integrally joined together and being initially spaced apart to define a cable-receiving aperture to receive an edge portion of said cable insertably between respective said inside surfaces thereof, and said first and second plate members adapted to be urged together about a bending region toward and against major surfaces of said cable therebetween, said first plate member having a plurality of opening means therethrough, said termination end further comprising a plurality of lance means integral with said second plate member and profiled for piercing through the insulation and the conductor of said cable and extending upwardly through respective ones of said opening means, said lance means and said opening means being substantially aligned parallel with said bending region and spaced therefrom; and an electrical interconnection end extending from and electrically commoned to said plate means and including interconnection means adapted to be electrically engaged by contact means of corresponding electrical conductive means for the distribution of electrical power from the cable and through a matable electrical connection to the corresponding electrical conductive means, whereby when a flat power cable is placed adjacent to the inside surface of the first plate member and the first and second plate members are rotated about the bending region such that their inside surfaces are moved toward each other, the plurality of lance means are forced through the power cable and pierce through the insulation and the conductor of the cable, normal to a surface of the cable, and extend through the opening means, establishing a plurality of mechanical joints with the cable and a plurality of electrical connections with the conductor of the cable, thereby defining a flat cable termination adapted to be manipulated and mated with the contact means of the corresponding electrical conductive means to transmit power thereto.

2. The adapter of claim 1 wherein said lance means extend from edges of said second plate member.

3. The adapter of claim 2 wherein said opening means comprise arcuate guide means struck outwardly from said inside surface.

4. The adapter of claim 3 wherein said lance means are integral with said second plate member and formed upwardly relatively to said second plate member and disposed proximate to said arcuate guide means.

5. The adapter to claim 2 wherein said first and second plate members are stamped and formed from a blank and are integrally connected therebetween by said electrical interconnection end, the adapter being formed by folding said blank such that said first and second plate members lie proximate to one another, and said electrical interconnection end is folded over, whereby said electrical interconnection means is comprised of a double thickness of metal.

6. The adapter of claim 5 wherein said electrical interconnection end comprises a plurality of tines extending between said first and second plate members, said tines thereby being folded over into a double thickness of metal.

7. The adapter of claim 1 wherein said electrical interconnection end comprises a plurality of means for securing and interconnecting a like plurality of electrical terminals thereto.

8. The adapter of claim 7 wherein said electrical interconnection means comprises a plurality of tine members extending from at least one of said first and second plate members.

9. The adapter of claim 1 wherein said electrical interconnection means comprises a through hole profiled for installation over a threaded member.

10. The adapter of claim 1 wherein said electrical interconnection means comprises means for interconnection to a printed circuit board.

11. The adapter of claim 10 wherein said means for interconnection to the printed circuit board comprises tines extending from said first plate member adapted to be insertably received into corresponding through holes of the printed circuit board.

12. The adapter of claim 10 wherein said means for interconnecting to the printed circuit board comprises tines adapted for right angle mounting to respective circuit pads disposed on a surface of the printed circuit board.

13. The adapter of claim 1 wherein said electrical interconnection means are tines profiled for interfering interconnection to conductive through holes.

14. The adapter of claim 13 wherein said tines further comprise a sheared section along the longitudinal length of each said tine, each portion of said sheared section adjacent to the shear being formed in opposite directions to form a compliant section.

15. A power distribution assembly for the distribution of power throughout an electronics system, the assembly comprising:

a flat power cable having a low profile conductor with insulation therearound; and an adapter member having a plurality of means adapted to pierce and extend through the insulation and the conductor and be deformed to secure said adapter member to said cable, mechanically joining and electrically connecting the adapter member thereto at a plurality of locations, the adapter member further comprising a plurality of tines extending therefrom and adapted to be mated with contact means of corresponding electrical conductive means for the distribution of power from the cable to the corresponding electrical conductive means.

16. The assembly of claim 15 further comprising a plurality of electrical terminals individually crimped to said tines.

17. The assembly of claim 16 further comprising an insulative housing for surrounding said adapter member.

18. The assembly of claim 17 further comprising an insulative connector housing having a plurality of cavities therein aligned as said terminals, and profiled for receiving said terminals.

19. The assembly of claim 15 wherein said tines are profiled for electrical interconnection to a power bus member for distribution of the power from the bus member.

20. The assembly of claim 19 wherein the tines are profiled for interconnection to a printed circuit board.

21. An adapter which is electrically and mechanically connectable to a flat insulated power cable which distributes power throughout an electrical system comprises:

a conductive body means;

an insulation displacement portion associated with the conductive body means and having a plurality of lances for piercing through the insulation and the flat conductor of the flat insulated cable at a plurality of locations and thereafter for being deformed against the cable, establishing a plurality of mechanical joints with the cable and a plurality of electrical connections with the conductor; and an electrical interconnection end which comprises a plurality of tines extending from said conductive body means and adapted to be electrically engaged by contact means of a like plurality of corresponding electrical conductive means, the plurality of tines providing for a division of current passing through said cable and distribution of the divided current to the respective electrical conductive means.

22. The adapter of claim 21 wherein said insulation displacement portion comprises opposing first and second plate members, one thereof having a plurality of opening means therethrough and the other thereof having a like plurality of lance means integral therewith and profiled for projecting through the insulation and conductor of the cable and through respective said opening means.

23. The adapter of claim 22 wherein said first and second plate members have integrally connected between themselves said plurality of tines, said tines being folded over upon themselves each to comprise a double thickness of metal.

24. The adapter of claim 22 wherein said first and second plate members include barb means on surface means adjacent to the insulation, the insulation displacement portion of the adapter being connectable to the cable by bringing said first and second plate members in abutting relationship with the insulation, said barb means projecting through the insulation forming a primary electrical connection between the adapter and the cable conductor.

25. The adapter of claim 21 wherein said conductive body means is comprised of an upper conductive body member and a lower conductive body member.

26. The adapter of claim 25 wherein said insulation displacement portion comprises a plurality of lance means extending from said upper conductive body member and a like plurality of die means disposed in said lower conductive body member.

27. The adapter of claim 26 wherein each of said lance means comprises edges sloping upwardly in two converging directions to define a point at the end of said lance means.

28. The adapter of claim 27 wherein each of said die means comprises a rectangular opening profiled to have edges for interferingly fitting with a corresponding one of said lance means, said point of said lance means profiled to puncture the insulation, and said lance means in said die means concentrating the shear forces at said edges of said die means propagating a shearing of said insulation in two directions.

29. The adapter of claim 25 wherein said electrical interconnection end comprises two tine members in overlaying relationship connected to each other.

30. The adapter of claim 25 wherein said electrical interconnection end comprises a first tine portion extending from one of said conductive body members, and a second tine portion extending from the other of said conductive body members, said second said tine member overlappingly surrounding said first tine member to adjoin said upper and lower conductive body members.

31. An adapter which is electrically and mechanically connectable to a flat insulated power cable and is matable and unmatable with another electrical article for distributing electrical power throughout an electrical system, comprising:

a termination end connectable to a cable, and an electrical interconnection end for interconnecting with another electrical article, wherein:

said termination end includes plate means comprising at least opposing first and second plate members each with an inside and an outside surface, said first and second plate members being integrally joined together and being initially spaced apart to define a cable-receiving aperture to receive an edge portion of said cable insertably between respective said inside surfaces thereof, and said first and second plate members adapted to be urged together about a bending region toward and against major surfaces of said cable therebetween;

said second plate member including a plurality of lances integral therewith extending from joints aligned with and spaced from said bending region, each said lance being profiled for piercing through the insulation and conductor of said cable, said lances extending toward said inside surface of said first plate member and into said cable-receiving aperture and having a length at least three times the thickness of said cable;

said first plate member having a plurality of opening means therethrough aligned with respective said lances and adapted to receive said lances therethrough; and said electrical interconnection end extends from and is electrically commoned to said plate means and includes interconnection means adapted to be electrically engaged by contact means of said another electrical article for the distribution of electrical power from the cable and through a matable electrical connection to the electrical article, whereby when a flat power cable is placed adjacent to the inside surface of the first plate member and the first and second plate members are rotated about the bending region such that their inside surfaces are moved toward each other, the plurality of lances are forced through the power cable and pierce through the insulation and the conductor of the cable, normal to a surface of the cable, and end portions of the lances extend through and beyond the opening means to be deformed against the outside surface of the first plate means, establishing a plurality of mechanical joints with the cable and a plurality of electrical connections with the conductor of the cable, thereby defining a flat cable termination adapted to be manipulated and mated with and unmated from the contact means of the electrical article to transmit power thereto.

32. A power distribution assembly for the distribution of power throughout an electronics system, the assembly comprising:

a flat power cable having a low profile conductor with insulation therearound and having opposing major surfaces; and an adapter member including first and second cable-proximate portions extending along said major surfaces of said cable and having a plurality of lances extending toward said first portion from said second portion and adapted to pierce and extend through the insulation and the conductor of said cable from one major surface thereof and through corresponding apertures of said first portion of said adapter member disposed along the other major surface of said cable to be deformed against an outside surface of said first portion to secure said adapter member to said cable, mechanically joining and electrically connecting the adapter member thereto at a plurality of locations, the adapter member further comprising a plurality of tines extending therefrom and adapted to be mated with and unmated from contact means of corresponding electrical conductive means for the distribution of power from the cable to the corresponding electrical conductive means.

33. An adapter which is electrically and mechanically connectable to a flat insulated power cable and dividing and distributing electrical power throughout an electrical system comprises:

a conductive body means;

an insulation displacement portion associated with and joined to said conductive body means and having a first portion extending along a first major surface of a flat insulated power cable and a second portion extending along a second major cable surface, said first portion including a plurality of lances for piercing through the insulation and the flat conductor of the flat cable from said first major surface thereof at a plurality of locations and having end portions extending at least beyond the second major surface of the cable after piercing the cable for extending through corresponding apertures in said second portion and being deformed against an outside surface of said second portion, establishing a plurality of mechanical joints with the cable and a plurality of electrical connections with the conductor; and an electrical interconnection end which comprises a plurality of tines extending from said conductive body means and adapted to be electrically engaged by contact means of a like plurality of corresponding electrical conductive means, the plurality of tines providing for a division o current passing through said cable and distribution of the divided current to the respective electrical conductive means.

* * * * *